US005455065A

United States Patent [19]

Rood

[11] Patent Number: 5,455,065

[45] Date of Patent: Oct. 3, 1995

[54] TREATMENT FOR IMPROVING CELLULOSIC INSULATION

[76] Inventor: Leonard D. Rood, 5764 Flintlock La., Columbus, Ohio 43213

[21] Appl. No.: 304,112

[22] Filed: Sep. 12, 1994

Related U.S. Application Data

[63] Continuation-in-part of Ser. No. 212,367, Mar. 14, 1994, Pat. No. 5,399,375.

[51] Int. Cl.[6] ..... B05D 3/02; A62C 3/04; A62C 5/02

[52] U.S. Cl. ..... 427/203; 427/393.3; 427/373

[58] Field of Search ..... 106/18, 13; 427/201, 427/203, 343, 403, 393.3, 373

[56] References Cited

U.S. PATENT DOCUMENTS

| | | | |
|---|---|---|---|
| 3,674,540 | 7/1972 | Pergaminos | 427/343 |
| 3,676,170 | 7/1972 | Kempthorne | 427/201 |
| 4,132,655 | 1/1979 | Draganov | 106/18.13 |
| 4,182,681 | 1/1980 | Gumbert | 106/18.13 |
| 4,184,311 | 1/1980 | Rood | 106/18.14 |
| 4,645,696 | 2/1987 | Rood | 252/2 |
| 4,990,368 | 2/1991 | Johnson et al. | 427/201 |

*Primary Examiner*—Diana Dudash

*Attorney, Agent, or Firm*—Frank H. Foster; Kremblas, Foster & Millard

[57] ABSTRACT

A method for manufacturing fire retardant cellulose fibers. The method comprises mixing limestone with shredded cellulosic fibers, mixing an acidic agent with the fibers, and depositing water on the mixture of fibers, limestone and acidic agent. A chemical reaction results from the limestone and the acidic agent being combined in a sufficiently moist environment. The reaction liberates carbon dioxide gas which causes a mechanical foaming action, thereby breaking down and distributing the produced particles of the chemical reaction. The preferred acidic agent is ammonium sulfate combined with boric acid. The method preferably includes the application of an anti-static agent in the step that includes mixing the limestone with the fibers. The water deposited preferably comprises an amount substantially in a range from 6%–16% of the weight of the fibers.

15 Claims, No Drawings

TREATMENT FOR IMPROVING CELLULOSIC INSULATION

This application is a continuation-in-part of my application, Ser. No. 08/212,367, filed Mar. 14, 1994, now U.S. Pat. No. 5,399,375.

TECHNICAL FIELD

This invention relates generally to cellulosic insulation of the type utilizing a shredded newspaper base which is treated with a fire retardant chemical composition and used for the thermal insulation of homes and other building structures. More particularly, the invention relates to a method of addition of chemical agent which results in improvements in the characteristics of the finished product, including reduced cost and improved effectiveness.

BACKGROUND ART

The manufacture of cellulosic insulation in accordance with the present state of the art begins with a grinding operation in which newspapers are shredded to provide a mass of cellulosic fibers.

A fire retardant composition is then mixed with the cellulosic fibers in order to coat them with the fire retardant material. This mixing is conventionally accomplished in one of two manners.

The fire retardant may be dissolved in a suitable solvent such as water and then sprayed into a stirred mass of the shredded cellulosic material. The spray application of the retardant may be performed simultaneously with a grinding step for shredding the cellulosic material or as a subsequent step.

One of the major disadvantages of the solution spray application system is that the resultant mixture becomes a sticky, gummy mess which is difficult to handle and requires drying.

A different method for using water in the manufacture of cellulosic insulation includes applying water to the particles of cellulosic material which carry fire retardant powder particles on their surfaces. The water forms a solution of the fire retardant composition on the cellulose fibers. This method is limited to non-hygroscopic, boric acid or borate fire retardant compositions. The amount of water required to obtain acceptable chemical distribution is approximately 30% of the weight of the shredded cellulose fibers. This requires prolonged treatment under hot and humid conditions, and requires a drying treatment to lower the moisture content of the final product to a practical level. Additionally, the water applied to the fire retardant and fiber mixture does not change the chemical composition of the fire retardant agent. The water added is for the purpose of improving distribution of the fire retardant agent on the fibers.

Alternatively fire retardant may be applied in dry powdered form which may be mixed with stirred cellulosic fibers during a grinding operation or an independent stirring operation. However, difficulty is experienced in effecting the adhesion of the fire retardant particles to the cellulosic shredded material with a sufficiently durable bond. It also has been difficult or impossible to obtain a complete and uniform coating of fire retardant on the cellulosic particles.

These latter problems have, in the current state of the art, been reduced somewhat by spraying small quantities of water on the cellulosic material before mixing in the fire retardant in order that the dry fire retardant particles will be wetted when they come into random contact with the cellulosic fibers. Thus, the particles are adhered to the cellulosic fibers by the wetting activity of the moisture.

However, even this system has several disadvantages including the still somewhat agglomerated or clumpy nature of the finished product, the non-uniform and incomplete coating of the fibers and the need for drying the insulation after the retardant is applied.

While attempting to find a means for reducing the dust generated during the manufacture of shredded cellulosic insulation, an anti-static agent was sprayed upon the shredded cellulosic insulation. It was eventually discovered that advantages could be gained by mixing and effecting the adhesion of an anti-static agent with the fire retardant agent prior to depositing the fire retardant agent on the shredded cellulosic material. This discovery was the subject of my prior patent U.S. Pat. No. 4,645,696. After the anti-static and the fire retardant agent were mixed, they are mixed with and deposited upon the shredded cellulosic material.

The anti-static agent may be added, mixed or blended with a particulate fire retardant agent either by mixing or spraying a liquid solution of the anti-static agent onto the particulate fire retardant agent or by blending a particulate anti-static agent with the particulate fire retardant agent.

Preferably the shredded cellulosic material is substantially unwetted at the time it is mixed with a mixture of anti-static agent and fire retardant agent. It has been found that the dry shredded cellulosic material accomplishes better coating of the cellulosic fibers with the fire retardant agent than is accomplished if the cellulosic fibers are prewetted as done in the prior art.

In my U.S. Pat. No. 4,645,696 the anti-static constituent of the mixture of anti-static agent and the retardant agent was preferably on the order of 0.1% to 1% by weight in a system in which the finished product is loaded with 20% retardant. The important proportion is believed to be the proportion of anti-static agent used in the finished insulation product. Preferably, in the invention of the prior patent, the finished product was 0.02% to 0.2% by weight of anti-static agent.

BRIEF DISCLOSURE OF INVENTION

The invention contemplates combining limestone and an acidic agent, preferably a fire retardant, which will react in the presence of sufficient water. The resulting chemical reaction produces a mechanical foaming action which physically distributes the products of the reaction between the limestone and acidic agent widely among the cellulosic fibers.

The mixture of limestone, acidic agent and water may be precoated with either limestone or acidic agent alone or with an anti-static agent. The addition of water to the mixture of limestone and the acidic agent produces cellulose fibers with far superior fire retardancy than is presently available. Additionally, the chemical reaction between the limestone and the acidic agent, such as ammonium sulfate, produces additional fire retardants which further aid the fire retardancy of the cellulose insulation, even beyond that of the original chemicals.

DETAILED DESCRIPTION

I have found that a less expensive, improved, and more fire retardant cellulose insulation, requiring less anti-static agent, can be made by pre-coating the shredded cellulose material with a mixture of anti-static agent and fire retardant agent, followed by addition of fire retardant agent only. This is the subject of the above cited copending patent application. By "fire retardant agent only", it is meant that some other chemical agent may be added with the fire retardant, but no substantial or effective amount of anti-static agent is added with the fire retardant agent in the second step of adding fire retardant agent after the precoat. Since the cost of the anti-static agent can be as high as $2.50 per pound, reducing the required amount of anti-static agent is a significant saving. The precoat mixture of anti-static agent and fire retardant agent is preferably added to the newsprint raw material prior to being ground to its final form, but may also be added to the newsprint in its final form with good results. The additional fire retardant agent is preferably added in an air stream, after the shredding operation, to the paper fibers previously precoated with the mixture of anti-static agent and fire retardant agent.

The anti-static agent constituent of the precoat mixture of anti-static agent and fire retardant is preferably on the order of 0.001% to 0.01% by weight of the total system of anti-static agent, fire retardant agent and newsprint raw material. Thus, by using an initial precoat, I have found that the amount of anti-static agent may be reduced by a factor of 20. The precoat constituent of the mixture of precoat and newsprint raw material should preferably be in the range of 1% to 5% of the weight of the newsprint raw material so that a single layer of fire retardant is formed on the fibers. Less than the minimum amounts may be insufficiently effective and more than the maximum amounts seems to promote agglomeration and does not seem to provide sufficiently improved results to justify the cost of the use of the additional material. It should be understood that quantities outside these ranges and other combinations of agents can be useful.

I have now discovered that the mixing of limestone particles and an acidic agent with the cellulosic fibers and depositing water upon that mixture provides substantial fire retardancy. The fire retardancy is further improved by use of an anti-static agent as described above and is even more improved by using the anti-static agent in the above described precoat method.

For example, adding only limestone or only acidic agent (no anti-static agent) as a precoat can result in a successful precoat making a second addition of a fire retardant agent substantially improved over no precoat at all. However, it has been found that a limestone or acidic agent only precoat does not as effectively prepare the fibers for the second coating of fire retardant agent as does a limestone plus anti-static agent precoat or an acidic agent plus anti-static precoat.

There are various types of anti-static agents described in the prior art. It has been found that one effective class of agents which is effective in the present invention are the quaternary ammonium compounds. These are the preferred anti-static agents.

An anti-static agent is a type of material recognized in the art. It is added to another material to reduce the propensity of the other material to accumulate charge and to aid in the discharge of localized charges which might accumulate on the other material.

Most anti-static agents increase the conductance at the surface of the material being treated. Of these, most are hygroscopic in order to form a surface layer of moisture. Frequently the anti-static agent is also an electrolyte Which improves the conductance of the moisture layer.

A variety of materials has been identified and others may be identified in the future which exhibit anti-static properties. To be useful as an anti-static agent a material must retain its anti-static properties at low humidity and must be sufficiently durable that aging and mechanical actions such as friction do not quickly destroy the anti-static properties.

Many materials have been identified in the art as anti-static agents and these include variations of cross linked polyamines containing polyethoxy segments, Dialkyldimethyl ammonium salts, Alkyl benzyldimethyl ammonium chlorides and Alkyl triethyl ammonium salts. The materials I prefer are Dimethyl distearyl ammonium chloride and Dimethyltallow ammonium chloride.

Thus, generally an anti-static agent is a surfactant which is sufficiently hygroscopic to form a solution with water in equilibrium with the ambient atmosphere. The anti-static agent must have a sufficiently low vapor pressure that it will not be lost by evaporation. Some literature states that an anti-static agent should be in equilibrium with an atmosphere having a relative humidity of as low as 25% and preferably, they supply ions for electrolyte activity.

Because the preferred anti-static agents are selected to be those which are hygroscopic and consequently have a high affinity for water to form the electrically conductive surface layer, the presence of the water also improves the resistance to fire because the additional moisture aids in the dousing of any fire introduced into the insulation. This characteristic is particularly significant in the low humidity ambient environment often found in attics or other areas of building structures which are exposed to high heat especially in the summer season.

Upon observing the improved characteristics described above, an attempt was made to study them and formulate a theory explaining these phenomena. The inventor's theory of the operation of the anti-static agent was described in the prior patent.

There is an advantage to applying the fire retardant agent treated in accordance with the present invention as a precoat on the cellulosic fibers before introduction of additional fire retardant agent. Limiting the amount of the mixture of anti-static agent and fire retardant agent initially added to the newsprint raw material by use of the precoat method forms a more uniform, single layer coating which leaves coating space for the rest of the fire retardant agent. Combining the anti-static agent with all of the fire retardant agent results in a less uniform, more agglomerated deposit of the mixture of anti-static agent and fire retardant agent. This less uniform deposit leaves some paper areas with a thinner, less fire retardant coating than is obtained using the precoat method. I theorize that, by mixing all of the fire retardant agent with anti-static agent, the anti-static agent was unnecessarily over-diluted by the fire retardant agent which reduced its effectiveness. By precoating with considerably less fire retardant agent, the fire retardant agent in the precoat acts as a carrier which carries the anti-static agent onto the surface of the paper where it prepares the surface for the receipt of the major portion of the fire retardant agent.

The preferred amount of the combination of anti-static agent and fire retardant agent effective as a precoat varies from 1% to 5% of the weight of the shredded paper. Less than this amount does not appear to be as effective and more than this amount covers so much of the paper surface area as to not provide enough surface for the additional fire retardant agent to be effective.

A chemical system for use with the precoat method is a precoat consisting of limestone and an anti-static agent followed by the addition of ammonium sulfate and boric acid, and then water in an amount within a specific range. Because of the improved coating of the fibers produced by the precoat method and the chemical reaction between limestone, ammonium sulfate and boric acid in the presence of water, however, it is feasible to use a precoat consisting of limestone, without the inclusion of an anti-static agent, for fire retardant agents including limestone and ammonium sulfate. This is not preferred, however.

It is believed that, upon adding water, a chemical reaction occurs between the limestone and the ammonium sulfate forming a coating which includes reaction products and is more fire retardant than the original chemical combination (of limestone, boric acid and ammonium sulfate). This chemical reaction can be accelerated by heating the mixture either by adding heat, or due to the heat that is naturally generated by friction during mixing.

The preferred precoat system consists of limestone and an anti-static agent added as a precoat, followed by ammonium sulfate and boric acid added to the mixture. Upon adding water (in an amount within the range of 6%–16% of the weight of the added inorganic ingredients and the cellulose fibers) to the mixture of fibers, limestone, ammonium sulfate and boric acid, the limestone reacts with the ammonium sulfate and boric acid to produce, among other things, carbon dioxide gas. This gas creates a foaming action in the mixture which mechanically distributes the products of the reaction throughout the mixture. Furthermore, the reaction produces additional fire retardant agents that have melting and decomposition temperatures different than that of the reactants, and which are within a useful range.

When water added is within the preferred range of weight percents of the added inorganic ingredients and the cellulose fibers, no drying step is necessary. Therefore, the water can be sprayed onto the fibers during or after the cellulose fibers are installed in the attic, wall cavity, etc., as desired.

The primary necessary components of this moisture addition method include limestone, an acidic agent, and water in the amount of approximately 6–16% of the weight of the added inorganic ingredients and the cellulose fibers. The acidic agent is preferably a fire retardant agent, and in the preferred embodiment comprises ammonium sulfate and boric acid. However, ammonium sulfate alone can be used, as can monoammonium phosphate. Monoammonium phosphate has a high melting temperature, which may be desirable under some circumstances. Aluminum sulphate may also be used.

The precoat step aids in the distribution of the fire retardants prior to their reaction in the presence of water and further aids subsequent distribution by the foaming from the chemical reaction. Therefore, a precoat consisting of limestone and an anti-static agent will give good distribution of the fire retardant agent, and this will thereby improve even further the effect of the foaming reaction as an aid to distribution.

Although the precoat including anti-static agent is preferred because it gives good initial distribution of the fire retardant agent, it is not necessary since good fire retardancy results have been obtained using limestone without an anti-static agent as a precoat. Good results have also been obtained by mixing the acidic agent as a precoat and subsequently adding limestone and other agents. The good, although not the best, results are believed to be a result of the aid to distribution of the resulting fire retardant agents caused by the foaming reaction.

The products of the chemical reaction include compounds which have melting and/or decomposition temperatures across a useful spectrum. For example, one of the compounds believed to be produced is monoammonium acid sulfate with a melting temperature of 146.9° C. Other compounds which are believed to result from the described reaction include calcium sulfate and calcium borate. These compounds have effects on burning cellulose fibers which include melting and decomposing, and thereby releasing gases and absorbing heat. Both of these effects reduce the spread of heat through the cellulose insulation. The compounds produced are believed to have melting and decomposition temperatures across a spectrum of useful temperatures which provide fire retarding characteristics at different temperatures as heat progresses through the cellulose insulation. As the fire retardants are subjected to higher temperatures, there are different fire retarding effects caused by the melting and decomposing of the different retardants. These effects occur at different temperatures.

Because of the effectiveness of the products, the cellulose insulation has substantial improvement in fire retardancy over any cellulose insulation made using conventional fire retardant methods. This is believed to be caused by the products of the chemical reaction combining with water and .coating the fibers and also penetrating into the fibers. The products are therefore in place on or in the fibers when temperatures rise.

The invention can be illustrated further by the following examples, but it is understood that the invention is not meant to be limited to the details disclosed therein. In the examples, all parts and percentages are by weight unless otherwise noted.

This test was conducted on a basis wherein a four inch diameter by one inch deep aluminum pan was filled with a specimen of insulating material treated in accordance with the present invention. The sample was then heated by a 250 watt infrared bulb with the bulb face disposed approximately 10 inches above the bottom of the pan. After a period of three minutes, the specimen was ignited using a conventional paper book match. After an appropriate short period, the length and width of the burn area was measured in inches.

The material in these examples was prepared in the manner described below.

For the limestone particles, limestone, in dry form, was placed in a ball mill and ground to a particle size no greater than approximately 150 mesh. For the combination of limestone particles and anti-static agent, a dry anti-static agent was mixed with a pre-determined amount of the milled limestone using a mortar and pestle until a uniform mixture was assured.

For the case of all ingredients combined at once, a pre-determined amount of coarsely shredded paper was placed in a blender with a pre-determined amount of limestone or mixture of limestone and anti-static agent. A pre-determined amount of the acidic agent was then added. This combination was agitated in the blender for a 30 to 45 second time period to reduce the cellulosic particles to the approximate size of retaining one to two letters on the particle surface.

For the case of the precoat method, coarsely shredded paper and a pre-determined amount of limestone, or coarsely shredded paper and a pre-determined amount of a mixture of limestone and anti-static agent were agitated in a blender for a 30 to 45 second time period. A pre-determined amount of acidic agent was then added to the blender and the components in the blender were agitated for an additional 5 to 10 seconds.

In both of the preceding cases (precoat and combined), treated paper was removed from the blender and sprayed with water from a spray bottle to a moisture content of approximately 14% as measured by a Delmhorst paper moisture meter, Model PA-1, manufactured by Delmhorst Instrument Company, Boonton, N.J. The wetted material was allowed to condition for approximately 24 hours under ambient conditions.

Enough of the treated paper was added to fill an aluminum, 4" diameter pan, as previously described, to conduct the burn test.

Tables 1 and 2 contain a list of examples and include a burn evaluation column which is a good approximate measure of the fire retardant effectiveness. Burn area dimensions were compared for the case of adding limestone with the case of adding a mixture of limestone and anti-static agent to the shredded paper. Both of these cases (anti-static agent with limestone and limestone alone) are tested in the precoat method and in the case of all of the ingredients combined at one time.

Different tables compare data at pre-determined dosages of fire retardant. The fire retardant dosage, in weight percent, is based on the weight of the inorganic ingredients added and the cellulose fibers.

Table 3 consists of examples wherein various acidic agents were used as precoat materials with limestone added later. The use of an anti-static agent in the precoat mixture was also included. The precoat dosage was 4% of the weight of the input shredded paper. The limestone dosage was also 4% of the weight of the input shredded paper. These examples were prepared in the same way that the examples described above for limestone as a precoat, by substituting the precoat acidic agent for the limestone.

Table 4 consists of examples showing that the precoat method of adding limestone only as the precoat portion of the fire retardant agent increased fire retardant effectiveness compared with combining substantially all of the ingredients. The loading of fire retardant agent was nineteen percent.

The anti-static agent used was dimethyl distearyl ammonium chloride at a dosage of 0.003% of the weight of the final cellulosic material. The limestone component, consisting of limestone or a mixture of limestone and anti-static agent, was 4% of the weight of the input shredded paper. The term "singe" refers to a burn dimension equivalent to the match flame contact area.

TABLE 1

| Fire Retardant Dosage, 16.7% | | | | |
|---|---|---|---|---|
| | Limestone Component | | | |
| Example | Type | Addition Method | Acidic Agent | Burn, Inches |
| 1. | Limestone/ Antistat | Precoat | Ammonium Sulfate | Singe |
| 2. | Limestone | Precoat | Ammonium Sulfate | 1 × 2 |
| 3. | Limestone/ Antistat | Combined | Ammonium Sulfate | 1 × 1 |
| 4. | Limestone | Combined | Ammonium Sulfate | 2 × 3 |
| 5. | Limestone/ Antistat | | 5 pt Am Sulfate 1 pt Boric Acid | Singe |
| 6. | Limestone | Precoat | 5 pt Am Sulfate 1 pt Boric Acid | 1 × 1.75 |
| 7. | Limestone/ Antistat | Combined | 5 pt Am Sulfate 1 pt Boric Acid | Singe |
| 8. | Limestone | Combined | 5 pt Am Sulfate 1 pt Boric Acid | 2 × 2.5 |
| 9. | Limestone/ Antistat | Precoat | 3 pt Am Sulfate 1 pt Boric Acid | Singe |
| 10. | Limestone | Precoat | 3 pt Am Sulfate 1 pt Boric Acid | 1 × 1 |
| 11. | Limestone/ Antistat | Combined | 3 pt Am Sulfate 1 pt Boric Acid | Singe |
| 12. | Limestone | Combined | 3 pt Am Sulfate 1 pt Boric Acid | 1.25 × 1.75 |
| 13. | Limestone/ Antistat | Precoat | 5 pt Am Sulfate 1 pt Mono Am Phosphate | Singe |
| 14. | Limestone | Precoat | 5 pt Am Sulfate 1 pt Mono Am Phosphate | 1 × 2 |
| 15. | Limestone/ Antistat | Combined | 5 pt Am Sulfate 1 pt Mono Am Phosphate | 1.5 × 1.5 |
| 16. | Limestone | Combined | 5 pt Am Sulfate 1 pt Mono Am Sulfate | 1.75 × 2.5 |

TABLE 2

| Fire Retardant Dosage, 13.8% | | | | |
|---|---|---|---|---|
| | Limestone Component | | | |
| Example | Type | Addition Method | Acidic Agent | Burn, Inches |
| 1. | Limestone/ Antistat | Precoat | Ammonium Sulfate | Singe |
| 2. | Limestone | Precoat | Ammonium Sulfate | 2 × 2.75 |
| 3. | Limestone/ Antistat | Combined | Ammonium Sulfate | 2 × 3 |
| 4. | Limestone | Combined | Ammonium Sulfate | 3 × 3.5 |
| 5. | Limestone/ Antistat | Precoat | 5 pt Am Sulfate 1 pt Boric Acid | Singe |
| 6. | Limestone | Precoat | 5 Pt Am Sulfate 1 pt Boric Acid | 2 × 2.25 |
| 7. | Limestone/ Antistat | Combined | 5 pt Am Sulfate 1 pt Boric Acid | 1 × 1 |
| 8. | Limestone | Combined | 5 pt Am Sulfate 1 pt Boric Acid | 3 × 3 |
| 9. | Limestone/ Antistat | Precoat | 3 pt Am Sulfate 1 pt Boric Acid | Singe |
| 10. | Limestone | Precoat | 3 pt Am Sulfate 1 pt Boric Acid | 1 × 2.5 |
| 11. | Limestone/ Antistat | Combined | 3 pt Am Sulfate 1 pt Boric Acid | 1.5 × .75 |
| 12. | Limestone | Combined | 3 pt Am Sulfate 1 pt Boric Acid | 2 × 2 |

TABLE 3

| Fire Retardant Dosage, 16.7% | | | |
|---|---|---|---|
| Example | Precoat Acidic Agent | Additional Fire Retardant | Burn, Inches |
| 1. | Ammonium Sulfate | Ammonium Sulfate Limestone | 1 × 1 |
| 2. | Boric Acid | Limestone 5 pts Ammonium Sulfate 1 pt Boric Acid | .5 × .5 |
| 3. | Mono am phosphate | Limestone 5 pts Ammonium Sulfate | |

TABLE 3-continued

| Example | Precoat Acidic Agent | Additional Fire Retardant | Burn, Inches |
|---|---|---|---|
| | | Fire Retardant Dosage, 16.7% | |
| 4. | Ammonium Sulfate/ Antistat | 1 pt Boric Acid Limestone | 1 × 1 |
| | | 5 pts Ammonium Sulfate 1 pt Boric Acid | .5 × .5 |

TABLE 4

| Example | Fire Retardant | Limestone Addition | Precoat Weight As A Percentage Of Total Weight Paper | Burn Dimension, Inches |
|---|---|---|---|---|
| | | Fire Retardant Dosage, 19% | | |
| 1. | Limestone Ammonium Sulfate | Precoat Second addition | 4% | 2" × 3" |
| 2. | Limestone Ammonium Sulfate | Combined | | 4" × 4" |
| 3. | Limestone 5 pt Ammonium Sulfate 1 pt Boric Acid | Precoat Second addition | 4% | 1.75" × 3" |
| 4. | Limestone 5 pt Ammonium Sulfate 1 pt Boric Acid | Combined | | 4" × 4" |
| 5. | Limestone 5 pt Ammonium Sulfate 1 pt Boric Acid | Precoat Second Addition | 2% | 2" × 3.5" |

It should be pointed out that the results of retarding the burn area vary as a function of the specific fire retardant used. Some fire retardant agents or mixtures thereof are more effective than others. This is also true regarding certain specific anti-static agents.

Therefore, the specific choice of the agents used and their relative proportions are a function of the degree of effectiveness required and the cost as related to commercially practical results. Use of the precoat method significantly improved the effectiveness of the fire retardant agent and reduced the amount of anti-static agent required. Use of the addition of water combined with the precoat improved effectiveness even further. Therefore a significant saving can be realized in accordance with the present invention as well as other advantages as noted earlier herein.

It can be readily observed that the examples listed in Table 1 show that the precoat method of adding the anti-static agent and a portion of fire retardant agent increased fire retardant effectiveness compared with combining substantially all of the ingredients.

In general, there is an optimum mixture for each formulation which produces a minimum burn area. It is believed that this minimal burn area results from that mixture which produces the most uniform coating and which contains the least amount of component agglomeration.

While certain preferred embodiments of the present invention have been disclosed in detail, it is to be understood that various modifications may be adopted without departing from the spirit of the invention or scope of the following claims.

I claim:

1. A method for manufacturing fire retardant cellulose fibers comprising a mass of shredded cellulosic fibers having an inorganic fire retardant agent deposited on them, wherein the method comprises:

(a) applying a particulate coating comprising an acidic agent and limestone particles in a ratio of acidic agent to limestone greater than at least 1:1 onto the surface of said fibers;

(b) depositing water onto said fibers coated in step (a) in an amount sufficient to cause a chemical reaction between said acidic agent and said limestone particles to generate carbon dioxide in an amount sufficient to effect a more uniform distribution of the remaining particulate limestone, acidic agent and reaction products formed during said chemical reaction throughout said mass of fibers.

2. A method in accordance with claim 1 wherein the acidic agent is a fire retardant agent.

3. A method in accordance with claim 2 wherein the acidic agent comprises ammonium sulfate.

4. A method in accordance with claim 2 wherein the acidic agent comprises monoammonium phosphate.

5. A method in accordance with claim 2 wherein the acidic agent comprises ammonium sulfate and boric acid.

6. A method in accordance with claim 1 wherein the method further comprises mixing an anti-static agent with the limestone particles before coating the fibers with the limestone particles.

7. A method in accordance with claim 1 wherein the method further comprises mixing an anti-static agent with the acidic agent before coating the fibers with the acidic agent.

8. A method in accordance with claim 5 wherein the method further comprises mixing an anti-static agent with the limestone particles before coating the fibers with the limestone particles.

9. A method in accordance with claim 8 wherein the method further comprises coating the fibers with the mixture of the anti-static agent and the limestone particles in a precoating step prior to applying the coating of the acidic agent.

10. A method in accordance with claim 9 wherein the water deposited comprises an amount substantially in a range from 6% to 16% of the weight of the added inorganic ingredients and the cellulose fibers.

11. A method in accordance with claim 10 wherein the mixture is heated subsequent to depositing water on the mixture.

12. A method in accordance with claim 1 wherein the method further comprises coating the fibers with the limestone particles in a precoating step which is carried out prior to coating the fibers with the acidic agent.

13. A method in accordance with claim 1 wherein the method further comprises coating the fibers with the acidic agent in a precoating step which is carried out prior to coating the fibers with the limestone particles.

14. A method in accordance with claim 12 wherein the acidic agent comprises ammonium sulfate.

15. The method in accordance with claims 1 wherein the ratio of the particles of acidic agent to limestone particles coated on the fibers in step (a) is at least about 1.5 to 1.

* * * * *